United States Patent [19]

Pozsgay et al.

[11] Patent Number: 4,578,974

[45] Date of Patent: Apr. 1, 1986

[54] SEAMLESS TUBE MILL

[75] Inventors: Dezsoe A. Pozsgay; Robert J. Rau, both of Pittsburgh, Pa.

[73] Assignee: Aetna-Standard Engineering Company, Ellwood City, Pa.

[21] Appl. No.: 746,933

[22] Filed: Jun. 20, 1985

Related U.S. Application Data

[63] Continuation of Ser. No. 519,564, Aug. 2, 1983, abandoned.

[51] Int. Cl.[4] ..... B21B 19/04

[52] U.S. Cl. ..... 72/97; 72/96

[58] Field of Search ..... 72/96, 97, 68, 368, 72/370

[56] References Cited

U.S. PATENT DOCUMENTS

| | | | |
|---|---|---|---|
| 1,946,933 | 2/1934 | Diescher . | |
| 1,951,348 | 3/1934 | Diescher . | |
| 1,996,148 | 4/1935 | Diescher | 72/96 |
| 2,006,336 | 7/1935 | Diescher | 72/96 |
| 2,048,925 | 7/1936 | Diescher | 72/96 |
| 3,593,553 | 7/1971 | Rodder . | |

FOREIGN PATENT DOCUMENTS

| | | | |
|---|---|---|---|
| 2067112 | 7/1981 | United Kingdom | 72/97 |
| 2099346 | 12/1982 | United Kingdom | 72/97 |

OTHER PUBLICATIONS

Seamless Tube Mills by Aetna-Standard Engineering Co.

*Primary Examiner*—Lowell A. Larson

*Attorney, Agent, or Firm*—Mandeville and Schweitzer

[57] ABSTRACT

The disclosure is directed to a process and a mill installation for the production of seamless tubes of high quality, in production mills having relatively modest production requirements. The mill installation comprises a cross roll piercing mill for piercing and initially elongating a solid cylindrical billet. Preferably, but not in all cases, the cross roll piercer is followed by a second cross roll "piercer" which functions purely as an elongator, and which functions to substantially elongate the pierced billet, typically in conjunction with an increase in O.D. and reduction in wall thickness. As a key feature, the pierced billet, previously processed by either one or two cross roll piercer/elongators, is thereafter further elongated by means of a Diescher-type elongator, and most particularly a novel form of such Diescher type elongator incorporating a restrained mandrel bar feature. From the Diescher mill, the highly elongated tube is processed on a sizing mill for finish sizing and typically some additional elongation. Although the Diescher type elongator is a well known mill in a general sense, its use in the context of this invention is unique, as is its use in conjunction with a restrained mandrel. The new mill complex makes it economically feasible to install a seamless tube mill for the production of high quality tubing at production levels as low as 200,000–250,000 tons per year.

1 Claim, 8 Drawing Figures

19
20
18
50
51
52
53
54
55
56

SEAMLESS TUBE MILL

This is a continuation of Ser. No. 519,564 filed Aug. 2, 1983 and now abandoned.

BACKGROUND AND SUMMARY OF THE INVENTION

The present invention is directed to the production of seamless tubing, and more particularly to the provision of new procedures and a new complex of mill equipment for the production of high quality seamless tubing on an economical basis, at relatively low production levels.

The production of seamless tubing is, in general, an old and well known art. Typically, a heated billet is pierced, either in a press piercing mill or by way of a cross roll piercer. The pierced billet then undergoes one or more elongation stages for increasing the length of the billet while reducing its wall thickness and adjusting its diameter. Typically, the principal elongation stage involves the use of a mandrel mill, Assel mill, plug mill or push bench for example. Of these, the mandrel mill is generally accepted as the most productive. However, the mandrel mill is an expensive installation and thus not easily adapted for the economical production of seamless tubing at relatively low production levels as contemplated by the present invention. The other mentioned elongation processes, on the other hand, while being less costly to install have certain quality limitations that tend to restrict the end use of the resulting product. For example, because of the relatively abrupt transitional change in the roll diameter of the Assel mill, the surface of the resulting tubular product often has a somewhat "crazed" appearance, making it relatively unacceptable for oil field use, for example, because of concerns over failure.

The present invention is directed to a new seamless tube process which, at relatively low capital cost, more or less competitive with Assel mill installations, for example, nevertheless enables a uniquely high quality of seamless tubing to be produced, without the limitations characteristic of the Assel mill. More specifically, pursuant to the process and installation of the invention, the primary elongator facility is a Diescher type mill provided with a restrained mandrel system. With this arrangement, it is possible in a seamless tube mill of so-called "mini-mill" proportions, to produce tubing of very high quality, in a wide range of sizes up to ten inches and more in diameter and in so-called "double length" sections, up to ninety-six feet in length.

Optimum quality and economy considerations are balanced in the procedure of the present invention by the use of so-called No. 1 and No. 2 cross roll piercers in advance of the Diescher type, restrained bar elongator. With this arrangement, it is possible to produce double length tubing to a high quality level in terms of concentricity and uniformity of wall thickness. Production of tubing in double length also provides for significant economies in terms of reduced crop end loss, as will be readily understood.

For a more complete understanding of the above and other features and advantages of the invention, reference should be made to the following detailed description of a preferred embodiment, and to the accompanying drawing.

DESCRIPTION OF PREFERRED EMBODIMENTS OF THE INVENTION

Figure 1:
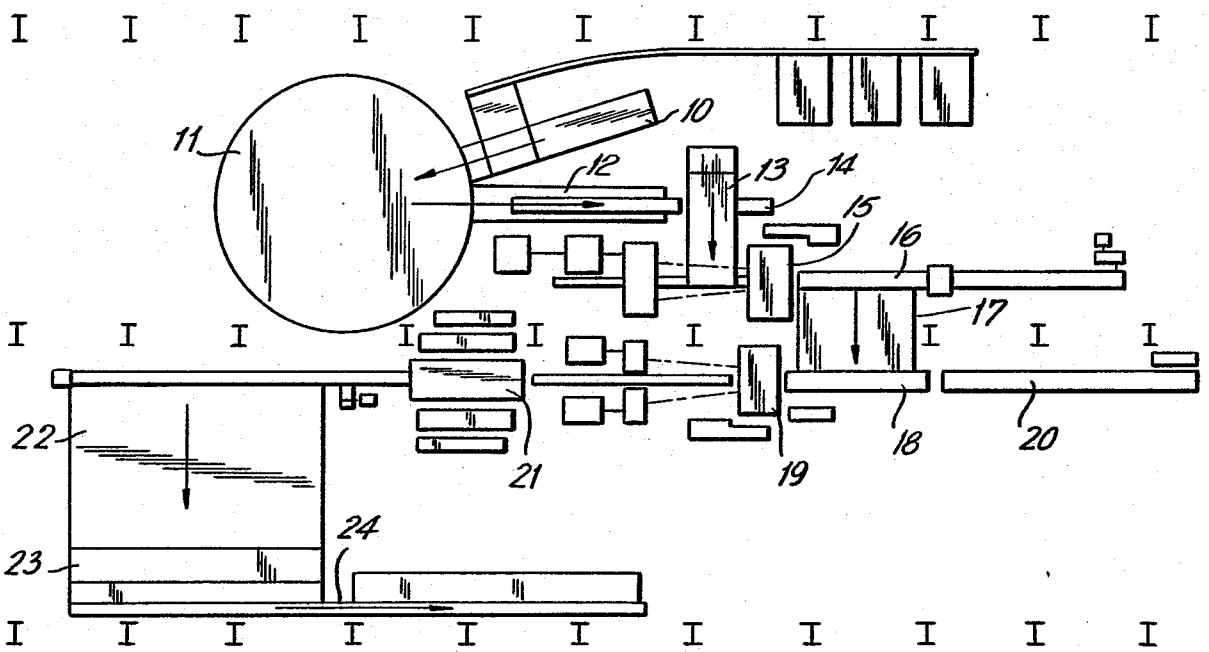
FIGS. 1 and 2 are simplified plant layout arrangements for the mill complex according to the invention, the installation of FIG. 1 utilizing a single cross roll piercer whereas the installation of FIG. 2 employs two cross roll piercers as in the capacity of No. 1 and No. 2 piercers, respectively.

In the plant layout illustration of FIG. 1, a billet inlet table 10 supplies billets, typically cylindrical in shape, to a rotary furnace 11 of a known type. The individual billets progress through the furnace 11, in a rotary direction, and are discharged one by one onto a hot billet conveyor 12. The conveyor 12 advances the billets onto a piercer inlet table 13, where the billet is center punched by means of a centering machine 14. The piercer inlet table 13 then transfers the billet into a Mannesmann type cross roll piercer 15, which drives the heated billet in a spiral fashion over a piercing mandrel in a well known manner, converting the solid cylindrical billet into a pierced, elongated tubular shell.

After extraction of the piercing mandrel, the shell is moved laterally by the piercer outlet transfer section 17 onto a shell inserter section 18 of a Diescher type elongator. The Diescher type elongator is, per se, of known construction as reflected in, for example, the Diescher U.S. Pat. No. 1,946,933 and the Diescher U.S. Pat. No. 1,951,348. The Diescher mill is a well known, although not widely used, type of cross roll piercer/elongator utilizing relatively large diameter guide discs in conjunction with opposed, angularly related cross rolls.

Pursuant to a significant aspect of the invention, the Diescher mill, designated by the reference numeral 19, is used in the capacity of an elongator and is provided with a mandrel bar inserter section 20 of a restrained mandrel type. The restrained mandrel principle is, in itself, well known and is described in, for example, the William Rodder U.S. Pat. No. 3,593,553. The restrained bar mandrel arrangement 20 provides for insertion of the mandrel into a shell disposed on the shell inserter section 18, followed by the simultaneous insertion of the shell and mandrel into the rolls of the Diescher elongator 19. Once the tubular shell is in the grip of the elongator rolls, the mandrel bar movement is restrained and controlled by the bar inserter mechanism, such that the movement of the mandrel is greatly reduced in relation to the movement of the tubular shell through the elongator mill. Indeed, the mandrel may at times be stationary or even moving oppositely to the movement of the shell. In all cases, the mandrel is restrained from normal free floating movement through the elongator mill as is conventional. In this respect, the use of restrained bar mandrel arrangements is known for use in conjunction with mandrel mills, Assel mills, and so-called Transval mills. However, insofar as the applicants are aware, the restrained bar principle has never been applied to a Diescher mill and is unique in that application.

After passage through the restrained bar Diescher elongator 19, the now substantially elongated tubular shell is conveyed to a conventional sizing mill 21, from which it is deposited on a cooling bed 22. The elongated tubular shells are slowly advanced laterally along the cooling table, carried through a water bosh 23 and eventually removed on a run out conveyor 24.

Figure 2:
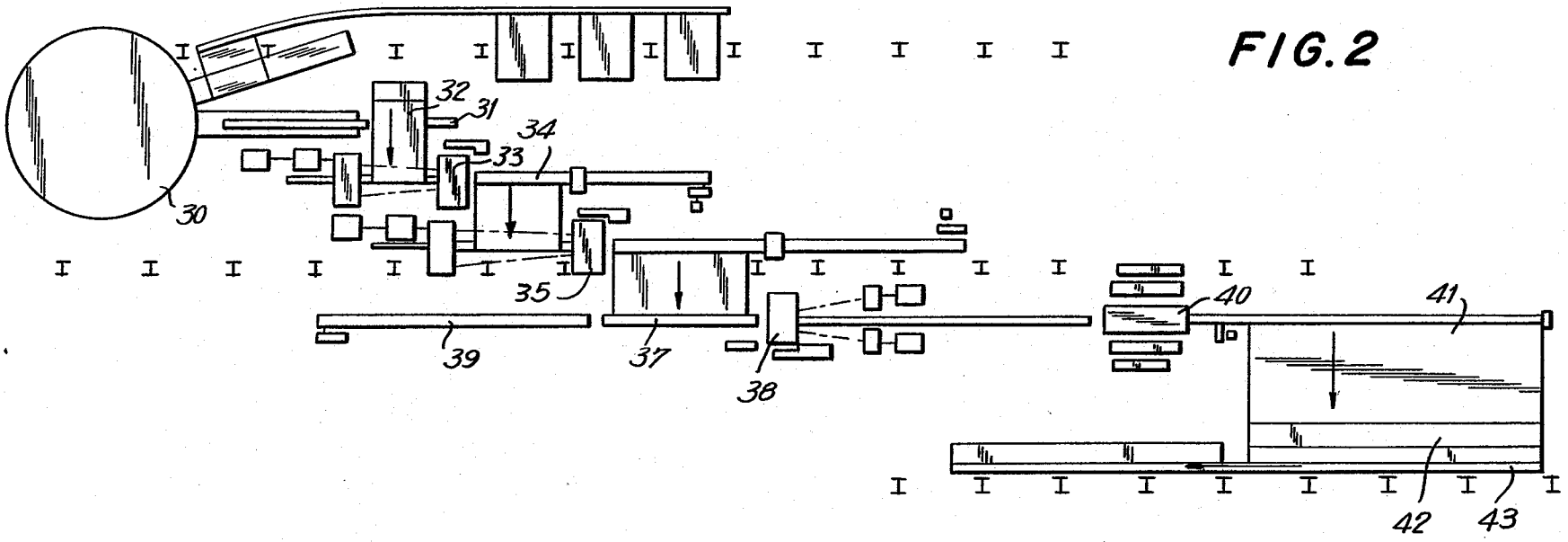

The plant layout arrangement of FIG. 2 is similar in principle to that of FIG. 1, except that an additional stage of elongation is provided by a No. 2 Mannesmann type piercer/elongator. In the system of FIG. 2, heated billets from the rotary furnace 30 are centered at the centering machine 31 and advanced by the piercer inlet table 32 into the first stage Mannesmann rotary type piercer 33, where the solid cylindrical billet is pierced and initially elongated to form a tubular shell. The shell is received by the outlet table 34 and transferred to the inlet table section of a so-called No. 2 piercer 35 of the Mannesmann type. The No. 2 Mannesmann piercer is of course not used in a piercing capacity, but is used as an elongator to provide a first stage of elongation of the pierced shell. The elongated shell is then transferred from the outlet table 36 to the inlet section 37 of a restrained bar Diescher type elongator 38 as generally described in connection with the layout of FIG. 1. A bar inserter 39 of the restrained mandrel type inserts a mandrel into a shell resting on the shell inserter 37, and both the shell and mandrel are then inserted into the Diescher type elongator 38, with the movement of the mandrel being controllably restrained during the advancement of the tubular shell through the Diescher elongator. The twice elongated shell is then passed through a sizing mill 40, cooling table 41, water bosh 42 and run out conveyor 43, in the manner of the layout of FIG. 1.

Figure 3:
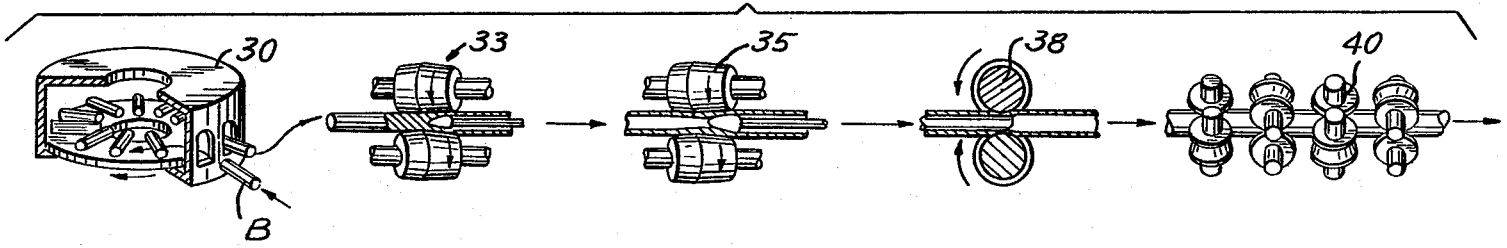
FIG. 3 is a highly simplified schematic illustration of the primary steps involved in the production of seamless tubing in accordance with the teachings of the invention.

FIG. 3 is a highly schematic illustration of the various stages involved in the layout of FIG. 2, illustrating the loading of a billet B into the rotary furnace 30 and discharge of the hot billet therefrom. The heated, solid billet is then pierced in the first stage Mannesmann piercer 30. In the second stage, the Mannesmann mill 35 is used as an elongator (No. 2 piercer), reducing the wall thickness of the tubular shell and elongating the shell correspondingly. In the restrained bar Diescher mill 38, the shell is elongated further and its wall thickness reduced. In the sizing mill 40, the diameter of the shell is reduced somewhat, and this typically is accompanied by a slight increase in wall thickness and some degree of elongation.

One of the unique and advantageous aspects of the new tube mill configuration is that the use of the restrained bar Diescher mill as the final stage elongator enables uniquely high quality output to be achieved in a mill of modest capital requirements fully suitable for so-called "mini mill" utilization, with tonnages in the area of 200,000–250,000 tons per year capacity.

In typical operation of a mill according to the layout of FIG. 1, processing may be carried out generally in accordance with the "Typical Rolling Schedule I". Typical starting materials are billets of five-ten inch diameter range, ranging in length from 4.79 feet minimum to 13.08 feet maximum. In this respect, the minima and maxima referred to in the typical rolling schedules are not in any sense limitations on the invention, but are merely minima and maxima of the particular rolling schedules illustrated.

In the first series of rolling schedules, the results of the piercing of the billet in the Mannesmann piercer are reflected under the heading "Piercer (Hot)". For example, the first billet size indicated, with an OD of 5.000 inches, length 7.50 feet, the OD is increased in the piercing operation to 5.250 inches and the billet is elongated by a factor of 2.90, to a length of 22.4 feet. Inside diameter (ID) after piercing is 4.36 inches and wall thickness is 0.446 inches.

The same billet, after processing in the restrained bar Diescher elongator, is further elongated by a factor of 2.36, to an overall length 52.85 feet, OD of 4.823 inches and wall thickness of 0.196 inches. Continuing to trace the same billet through the sizing mill, it will be observed that there is a further elongation of 1.24 in the sizing mill, to an overall length of 65.3 feet. The OD in the sizing mill is reduced to 3.548 with an accompanying increase in wall thickness to 0.219 inches. The finished tube, after cooling and end cropping, has an OD of 3.500, a length of 64.00 feet and a wall thickness of 0.216 inches.

In the Typical Rolling Schedule I, for the layout of FIG. 1, typical maximum/minimum starting lengths for a five inch billet are 13.08 feet and 6.15 feet. For a ten inch billet, typical maximum/minimum starting lengths are 9.99 feet and 5.86 feet. Range of elongation for a five inch billet typically would be 1.69 to 2.92; for a ten billet the equivalent range would be 2.77 to 3.62. Typical elongation in the Diescher restrained bar elongator, for a five inch billet would range from 2.05 to 2.48. For a ten inch billet, elongation will range from about 1.73 to about 2.26. In the sizing mill, elongation of a five inch billet ranges from abut 1.24 to about 1.28. For a ten inch billet, elongation in the sizing mill is minimal, about 1.02.

The finished tubes are of course cropped, to remove the out of spec. end sections. In finished form, the five inch billets will range in length from forty-five feet to sixty-four feet; finished OD is constant at 3.500; in wall thickness, the billets will range from 0.216 to 0.449. For ten inch billets, the schedules provides for a constant length of forty-eight feet and constant OD of 9.625 inches, with a range of wall thicknesses from 0.312 to 0.545. The main variable, wall thickness, for the ten inch billet, is primarily a function of the original length of the billet, as will be observed by comparison of starting billet length to finished wall thickness.

The layout of FIG. 1 of the invention is especially advantageous for mill requirements where a high level of concentricity is not a primary requirement and/or where it is either unnecessary or undesirable to provide for extremely high degrees of overall elongation from billet to final tube. Where the requirements are more stringent, the layout of FIG. 2 is more desirable, at the expense of providing an additional Mannesmann type piercer functioning as an elongator.

For the plant layout reflected in FIG. 2, "Typical Rolling Schedule II" is applicable. The illustrated schedule No. II provides for initial billet diameters in the range 5.375 inches to 10.5 inches, with initial billet lengths ranging, for the five inch billets, from 9.71 feet to 19.24 feet and for the ten inch billets 10.51 feet to 15.92 feet. It will be understood, in this respect, that the term "five inch billets" and "ten inch billets" as used in connection with Typical Rolling Schedule II, refers to a billet diameter of 5.375 and 10.5 inches respectively.

In the No. 1 Mannesmann piercer, the billets are processed without significant change in OD. The five inch billets are elongated by a factor of 1.35 to 1.78, while the ten inch billets are elongated in the range of 1.71 to 1.96. Max/min in wall thickness for the five inch billets at the No. 1 piercer are respectively 0.911 and 1.315 inches. For the ten inch billets, wall thicknesses range from 1.578 to 1.863 inches.

TYPICAL ROLLING SCHEDULE I

| PIERCER (HOT) | | | | | BILLET DATA (COLD) | | DIESCHER MILL (HOT) | | | | | | FINISHED TUBE (COLD) | | |
|---|---|---|---|---|---|---|---|---|---|---|---|---|---|---|---|
| OD | WALL | ID | LG | ELONG | OD | LG | GORGE | EQ OD | WALL | WALL RED | LG | ELONG | OD | WALL | LG |
| 5.250 | 0.446 | 4.36 | 22.4 | 2.92 | 5.000 | 7.50 | 4.750 | 4.823 | 0.196 | 0.250 | 52.85 | 2.36 | 3.500 | 0.216 | 64.00 |
| 5.500 | 0.782 | 3.94 | 17.7 | 1.69 | 5.000 | 10.21 | 4.750 | 4.824 | 0.407 | 0.375 | 36.27 | 2.05 | 3.500 | 0.449 | 45.00 |
| 5.250 | 0.464 | 4.32 | 26.1 | 2.81 | 5.000 | 9.03 | 4.750 | 4.823 | 0.214 | 0.250 | 58.48 | 2.25 | 4.000 | 0.226 | 64.00 |
| 5.500 | 0.687 | 4.13 | 17.5 | 1.89 | 5.000 | 9.04 | 4.750 | 4.823 | 0.312 | 0.375 | 40.99 | 2.35 | 4.000 | 0.330 | 45.00 |
| 5.450 | 0.618 | 4.21 | 18.4 | 2.09 | 5.000 | 8.57 | 4.750 | 4.823 | 0.268 | 0.268 | 44.79 | 2.44 | 4.500 | 0.271 | 45.00 |
| 5.500 | 0.709 | 4.08 | 21.1 | 1.84 | 5.000 | 11.18 | 4.750 | 4.823 | 0.334 | 0.375 | 47.68 | 2.27 | 4.500 | 0.337 | 48.00 |
| 7.375 | 0.645 | 6.08 | 15.4 | 2.62 | 6.750 | 5.72 | 6.625 | 6.731 | 0.270 | 0.375 | 38.12 | 2.49 | 5.000 | 0.296 | 45.00 |
| 7.375 | 0.832 | 5.71 | 21.2 | 2.09 | 6.750 | 9.85 | 6.625 | 6.732 | 0.457 | 0.375 | 40.01 | 1.90 | 5.000 | 0.500 | 48.00 |
| 7.375 | 0.715 | 5.94 | 18.7 | 2.39 | 6.750 | 7.63 | 6.625 | 6.714 | 0.340 | 0.375 | 40.96 | 2.20 | 5.500 | 0.361 | 45.00 |
| 7.375 | 0.766 | 5.84 | 21.3 | 2.25 | 6.750 | 9.25 | 6.625 | 6.714 | 0.391 | 0.375 | 43.54 | 2.05 | 5.500 | 0.415 | 48.00 |
| 7.625 | 0.704 | 6.22 | 20.5 | 2.34 | 6.750 | 8.57 | 6.875 | 6.967 | 0.329 | 0.375 | 45.65 | 2.23 | 6.625 | 0.330 | 45.00 |
| 7.625 | 0.849 | 5.93 | 26.1 | 1.98 | 6.750 | 12.84 | 6.875 | 6.968 | 0.474 | 0.375 | 48.58 | 1.87 | 6.625 | 0.475 | 48.00 |
| 9.375 | 0.629 | 8.12 | 17.1 | 3.48 | 8.750 | 4.79 | 8.625 | 8.742 | 0.254 | 0.375 | 43.40 | 2.55 | 7.000 | 0.272 | 48.00 |
| 9.375 | 0.880 | 7.61 | 24.0 | 2.56 | 8.750 | 9.13 | 8.625 | 8.744 | 0.505 | 0.375 | 42.94 | 1.80 | 7.000 | 0.540 | 48.00 |
| 9.375 | 0.684 | 8.05 | 19.6 | 3.31 | 8.750 | 5.76 | 8.625 | 8.732 | 0.289 | 0.375 | 46.15 | 2.37 | 7.625 | 0.300 | 48.00 |
| 9.375 | 0.978 | 7.42 | 27.4 | 2.33 | 8.750 | 11.47 | 8.625 | 8.734 | 0.603 | 0.375 | 45.79 | 1.68 | 7.625 | 0.625 | 48.00 |
| 9.750 | 0.678 | 8.39 | 21.2 | 3.11 | 8.750 | 6.65 | 9.000 | 9.112 | 0.303 | 0.375 | 48.79 | 2.31 | 8.625 | 0.304 | 48.00 |
| 9.750 | 0.930 | 7.89 | 28.3 | 2.33 | 8.750 | 11.81 | 9.000 | 9.114 | 0.555 | 0.375 | 48.69 | 1.73 | 8.625 | 0.557 | 48.00 |
| 10.750 | 0.1919 | 9.38 | 21.8 | 3.62 | 10.000 | 5.86 | 10.000 | 10.125 | 0.311 | 0.375 | 49.05 | 2.26 | 9.625 | 0.312 | 48.00 |
| 10.750 | 0.919 | 8.91 | 28.4 | 2.77 | 10.000 | 9.99 | 10.000 | 10.127 | 0.544 | 0.375 | 48.98 | 1.73 | 9.625 | 0.545 | 48.00 |

| SIZING MILL (HOT) | | | | | |
|---|---|---|---|---|---|
| OD | WALL | LG | ELONG | OD RED | WALL RED |
| 3.548 | 0.219 | 65.3 | 1.24 | 26.43 | −11.74 |
| 3.548 | 0.455 | 46.1 | 1.28 | 26.44 | −11.75 |
| 4.055 | 0.229 | 65.4 | 1.12 | 15.92 | −7.07 |
| 4.055 | 0.335 | 46.1 | 1.13 | 15.92 | −7.08 |
| 4.562 | 0.275 | 46.2 | 1.04 | 5.41 | −2.49 |
| 4.562 | 0.342 | 49.2 | 1.04 | 5.41 | −2.41 |
| 5.069 | 0.300 | 46.2 | 1.22 | 24.69 | −10.98 |
| 5.069 | 0.507 | 49.3 | 1.24 | 24.70 | −10.98 |
| 5.576 | 0.366 | 46.3 | 1.14 | 16.95 | −7.53 |
| 5.576 | 0.421 | 49.3 | 1.14 | 16.95 | −7.53 |
| 6.716 | 0.335 | 46.4 | 1.02 | 3.60 | −1.60 |
| 6.716 | 0.482 | 49.5 | 1.03 | 3.61 | −1.60 |
| 7.097 | 0.276 | 49.5 | 1.15 | 18.82 | −8.37 |
| 7.097 | 0.547 | 49.5 | 1.16 | 18.84 | −8.37 |
| 7.730 | 0.304 | 49.6 | 1.08 | 11.47 | −5.10 |
| 7.730 | 0.634 | 49.6 | 1.09 | 11.49 | −5.11 |
| 8.744 | 0.308 | 49.7 | 1.03 | 4.04 | −1.80 |
| 8.744 | 0.565 | 49.7 | 1.03 | 4.06 | −1.80 |
| 9.758 | 0.316 | 49.9 | 1.02 | 3.63 | −1.61 |
| 9.758 | 0.553 | 49.9 | 1.02 | 3.64 | −1.62 |

TYPICAL ROLLING SCHEDULE II

| FINISHED TUBE (COLD) | | | SIZING MILL (HOT) | | | | | | DIESCHER MILL (HOT) | | | | | |
|---|---|---|---|---|---|---|---|---|---|---|---|---|---|---|
| OD | WALL | LG | OD | WALL | LG | ELONG | OD RED | WALL RED | GROOVE | EQ OD | WALL RED | WALL | LG | ELONG WT |
| 3.500 | 0.216 | 96.00 | 3.548 | 0.219 | 97.8 | 1.32 | 31.82 | −14.14 | 5.125 | 5.204 | 0.192 | 0.250 | 74.57 | 2.38 |
| 3.500 | 0.449 | 90.00 | 3.548 | 0.455 | 91.7 | 1.36 | 31.83 | −14.15 | 5.125 | 5.205 | 0.399 | 0.375 | 67.76 | 2.06 |
| 4.000 | 0.226 | 96.00 | 4.055 | 0.229 | 97.8 | 1.19 | 22.08 | −9.81 | 5.125 | 5.204 | 0.209 | 0.250 | 82.78 | 2.27 |
| 4.000 | 0.330 | 90.00 | 4.055 | 0.335 | 91.7 | 1.20 | 22.09 | −9.82 | 5.125 | 5.205 | 0.305 | 0.375 | 76.97 | 2.37 |
| 4.500 | 0.271 | 90.00 | 4.562 | 0.275 | 91.8 | 1.09 | 12.34 | −5.49 | 5.125 | 5.205 | 0.260 | 0.350 | 84.49 | 2.47 |
| 4.500 | 0.337 | 96.00 | 4.562 | 0.342 | 97.9 | 1.10 | 12.35 | −5.49 | 5.125 | 5.205 | 0.324 | 0.375 | 89.84 | 2.29 |
| 5.000 | 0.296 | 90.00 | 5.069 | 0.300 | 91.9 | 1.24 | 26.09 | −11.60 | 6.750 | 6.858 | 0.269 | 0.375 | 74.65 | 2.49 |
| 5.000 | 0.500 | 96.00 | 5.069 | 0.507 | 97.9 | 1.26 | 26.10 | −11.60 | 6.750 | 6.859 | 0.454 | 0.375 | 78.34 | 1.90 |
| 5.500 | 0.361 | 90.00 | 5.576 | 0.366 | 91.9 | 1.15 | 18.49 | −8.22 | 6.750 | 6.840 | 0.338 | 0.375 | 80.20 | 2.20 |
| 5.500 | 0.415 | 96.00 | 5.576 | 0.421 | 98.0 | 1.16 | 18.49 | −8.22 | 6.750 | 6.841 | 0.389 | 0.375 | 85.27 | 2.05 |
| 6.625 | 0.330 | 90.00 | 6.716 | 0.335 | 92.1 | 1.04 | 5.32 | −2.37 | 7.000 | 7.094 | 0.327 | 0.375 | 89.43 | 2.24 |
| 6.625 | 0.475 | 80.95 | 6.716 | 0.482 | 82.9 | 1.04 | 5.33 | −2.37 | 7.000 | 7.095 | 0.470 | 0.375 | 80.37 | 1.87 |
| 7.000 | 0.272 | 96.00 | 7.097 | 0.276 | 98.2 | 1.18 | 22.21 | −9.87 | 9.000 | 9.123 | 0.251 | 0.375 | 83.46 | 2.57 |
| 7.000 | 0.540 | 96.00 | 7.097 | 0.547 | 98.2 | 1.20 | 22.22 | −9.88 | 9.000 | 9.124 | 0.498 | 0.375 | 82.43 | 1.80 |
| 7.625 | 0.300 | 96.00 | 7.730 | 0.304 | 98.3 | 1.11 | 15.17 | −6.74 | 9.000 | 9.112 | 0.285 | 0.375 | 88.79 | 2.39 |
| 7.625 | 0.625 | 87.65 | 7.730 | 0.634 | 89.8 | 1.12 | 15.18 | −6.75 | 9.000 | 9.114 | 0.594 | 0.375 | 80.34 | 1.68 |
| 8.625 | 0.304 | 96.00 | 8.744 | 0.308 | 98.4 | 1.04 | 6.64 | −2.95 | 9.250 | 9.365 | 0.299 | 0.375 | 94.84 | 2.32 |

-continued

TYPICAL ROLLING SCHEDULE II

| | | | | | | | | | | | | | | |
|---|---|---|---|---|---|---|---|---|---|---|---|---|---|---|
| 8.625 | 0.557 | 83.93 | 8.744 | 0.565 | 86.2 | 1.05 | 6.65 | −2.96 | 9.250 | 9.367 | 0.548 | 0.375 | 82.79 | 1.73 |
| 9.625 | 0.312 | 96.00 | 9.758 | 0.316 | 98.5 | 1.06 | 8.22 | −3.65 | 10.500 | 10.632 | 0.305 | 0.375 | 93.95 | 2.28 |
| 9.625 | 0.545 | 85.29 | 9.758 | 0.553 | 87.7 | 1.06 | 8.23 | −3.66 | 10.500 | 10.633 | 0.533 | 0.375 | 83.33 | 1.74 |

| PIERCER NO. 2 (HOT) | | | | | PIERCER NO. 1 (HOT) | | | | BILLET DATA (COLD) | |
|---|---|---|---|---|---|---|---|---|---|---|
| OD | WALL | ID | LG | ELONG WT | OD | WALL | LG | ELONG | OD | LG |
| 5.625 | 0.442 | 4.74 | 31.4 | 1.78 | 5.375 | 0.911 | 16.8 | 1.78 | 5.375 | 9.71 |
| 5.875 | 0.774 | 4.33 | 33.0 | 1.35 | 5.375 | 1.315 | 23.2 | 1.35 | 5.375 | 17.59 |
| 5.625 | 0.459 | 4.71 | 36.5 | 1.75 | 5.375 | 0.931 | 19.9 | 1.75 | 5.375 | 11.69 |
| 5.875 | 0.680 | 4.52 | 32.7 | 1.43 | 5.375 | 1.214 | 21.7 | 1.43 | 5.375 | 15.56 |
| 5.825 | 0.610 | 4.60 | 34.3 | 1.51 | 5.375 | 1.129 | 21.6 | 1.51 | 5.375 | 14.74 |
| 5.875 | 0.699 | 4.48 | 39.4 | 1.41 | 5.375 | 1.235 | 26.5 | 1.41 | 5.375 | 19.24 |
| 7.500 | 0.644 | 6.21 | 30.1 | 1.67 | 7.000 | 1.287 | 17.2 | 1.67 | 7.000 | 10.56 |
| 7.500 | 0.829 | 5.84 | 41.4 | 1.49 | 7.000 | 1.495 | 26.4 | 1.49 | 7.000 | 18.20 |
| 7.500 | 0.713 | 6.07 | 36.6 | 1.59 | 7.000 | 1.367 | 21.8 | 1.59 | 7.000 | 14.08 |
| 7.500 | 0.764 | 5.97 | 41.7 | 1.54 | 7.000 | 1.424 | 25.7 | 1.54 | 7.000 | 17.08 |
| 7.750 | 0.702 | 6.35 | 40.1 | 1.57 | 7.000 | 1.387 | 24.2 | 1.57 | 7.000 | 15.80 |
| 7.750 | 0.845 | 6.06 | 43.1 | 1.45 | 7.000 | 1.552 | 28.2 | 1.45 | 7.000 | 20.00 |
| 9.750 | 0.626 | 8.50 | 32.7 | 1.88 | 9.000 | 1.419 | 16.5 | 1.88 | 9.000 | 8.98 |
| 9.750 | 0.873 | 8.00 | 45.9 | 1.62 | 9.000 | 1.721 | 27.0 | 1.62 | 9.000 | 17.11 |
| 9.750 | 0.660 | 8.43 | 37.4 | 1.84 | 9.000 | 1.462 | 19.3 | 1.84 | 9.000 | 10.79 |
| 9.750 | 0.969 | 7.81 | 48.0 | 1.54 | 9.000 | 1.831 | 29.5 | 1.54 | 9.000 | 19.63 |
| 10.000 | 0.674 | 8.65 | 41.1 | 1.79 | 9.000 | 1.506 | 21.8 | 1.79 | 9.000 | 12.44 |
| 10.000 | 0.923 | 8.15 | 48.0 | 1.55 | 9.000 | 1.813 | 29.3 | 1.55 | 9.000 | 19.35 |
| 11.250 | 0.680 | 9.89 | 41.3 | 1.96 | 10.500 | 1.578 | 20.1 | 1.96 | 10.500 | 10.51 |
| 11.250 | 0.908 | 9.43 | 48.0 | 1.71 | 10.500 | 1.863 | 26.6 | 1.71 | 10.500 | 15.92 |

In the plant layout of FIG. 2, a first stage of elongation is carried out in the so-called No. 2 Mannesmann piercer elongator. Five inch billets are elongated in the range of 1.35 to 1.78, while ten inch billets are elongated in the range of 1.71 to 1.96. With significant reduction in wall thickness, as reflected in the rolling schedule under the headings piercer No. 1 and piercer No. 2.

In the procedure of the invention, a second stage of elongation is carried out in the restrained bar Diescher mill. For the five inch billet, elongation in the Diescher mill may be in the range of 2.06 to 2.47. For the tench inch billet, elongation may range from 1.74 to 2.28, again with significant reduction in wall thickness. Over the spectrum of starting billet diameters and lengths for Typical Rolling Schedule II, shell length after elongation in the Diescher mill may range from about 67.76 feet to about 94.84 feet, with corresponding substantial reduction in wall thickness from the No. 2 piercer.

In the sizing mill, further elongation may range from about 1.09 to about 1.32, for the five inch billet and at about 1.06 for the ten inch billet.

After cooling and cropping, tubing diameters typically will range from 3.5 to 9.625 inches OD, tubing length from 80.95 to 96.00 feet and wall thicknesses from 0.216 to 0.625 inch. In this respect, it is understood that any shell length over 96 feet after the sizing mill is cropped off to a standard maximum length of ninety-six feet.

In either of its basic illustrated forms, the procedure of the invention is substantially advantageous in providing for a mill procedure for the production of relatively high quality seamless tubing with a rather simple installation of equipment, requiring a minimal capital investment, for economical and efficacious operation on a mini-mill basis.

One of the key aspects of the new mill arrangement is the utilization of a restrained bar Diescher mill as the final elongator stage. In this respect, the Diescher mill is unique in several respects. First, because of the utilization therein of a restrained mandrel which, although known for other types of rolling mills has not, to the best of applicant knowledge, been utilized in a Diescher mill. Second, in the procedure of the invention, it is desirable and effective to drive the Diescher mill guide discs at a peripheral speed which is approximately equal to or only minimally faster than the throughput rate of the Diescher mill, being the rate of which the elongated tubing emerges from the discharge side of the mill. Existing Diescher elongator installations, insofar as the applicants are aware, are operated with disc peripheral speeds in the range of two to three times the throughput speed of the mill, although some Diescher mills, used strictly for piercing, utilize disc speeds substantially in the range of the output speed of the mill.

For operation of the Diescher mill in a restrained bar mode, pursuant to the invention, the bar inserter mechanism is designed for high speed advance and retraction, as well as low speed, controlled movement during mill operation. The bar inserter of course must accommodate full retraction of the mandrel bar beyond the end of the maximum pierced and (in the case of plant layout of FIG. 2) elongated shell. As reflected in the Typical Rolling Schedule II, the maximum length of elongated shell after leaving the No. 2 piercer may be approximately forty-eight feet. Pursuant to the invention, the mandrel bar may have a working area, at its forward end, on the order of ten feet in length, and a nonworking or "dummy" portion of the bar which is substantially longer, for example sixty-three feet in length.

FIGS. 4–8 illustrate a typical sequence of operations of the restrained bar mandrel and tubular shell during elongation in the restrained bar Diescher elongator. The numerals 18, 20 designate generally the shell inserter and bar inserter sections on the loading side of the Diescher mill, which is generally designated by the reference numeral 19. In the loading configuration, the mandrel bar 50 is fully retracted to a position in which the tip section 51 of the mandrel clears the shell inserter section sufficiently for loading of a tubular shell 52 of whatever length is being processed.

After loading of a shell onto the shell inserter section, the mandrel thrust block 53 is actuated forwardly to advance the mandrel 50 through the interior of the hollow shell 52 until the tip area 51 of the mandrel emerges from the leading end of the tubular shell. The mandrel may be projected slightly out of the forward end of the shell. A distance of about two feet is typical. During the bar insertion stage, forward movement of the tubular shell 52 is restrained by a retaining plate 54, which is elevated to a position to engage the tubular shell, while allowing passage of the mandrel.

After the initial insertion of the mandrel bar, the shell retainer plate 54 is retracted and a shell pusher plate 55 is advanced, along with the thrust block 53, to move the shell and mandrel bar together into the throat of the Diescher elongator 19.

Once the shell 52 is engaged by the working rolls of the Diescher elongator, further movement of the shell is under the control of those rolls. At this stage, the thrust block 53 is restrained, such that its forward motion may continue, although at a substantially lower rate of speed than the speed of a free floating mandrel bar.

For example, during the advance of a thirty foot long incoming shell through the mill, resulting in a Diescher-elongated shell of seventy-seventy-five feet, the restrained mandrel bar may be permitted to advance forward a distance of, say, six feet.

As the trailing end of the tubular shell clears the throat of the Diescher mill, the mandrel and shell are caused to advance together for a short distance, until the trailing end of the elongated tube reaches a stripping facility, which may be a set of rolls or a retractable stripper plate. At this stage, the mandrel is retracted relative to the elongated tube, completely separating the mandrel and allowing the tube to continue on its own to the next stage of operation, which is the sizing mill. The mandrel is thereupon fully retracted through the throat of the mill and to a position upstream of the shell inserter, in preparation for the introduction of the next shell to the Diescher elongator stage.

Figures 4, 5, 6, 7, 8:
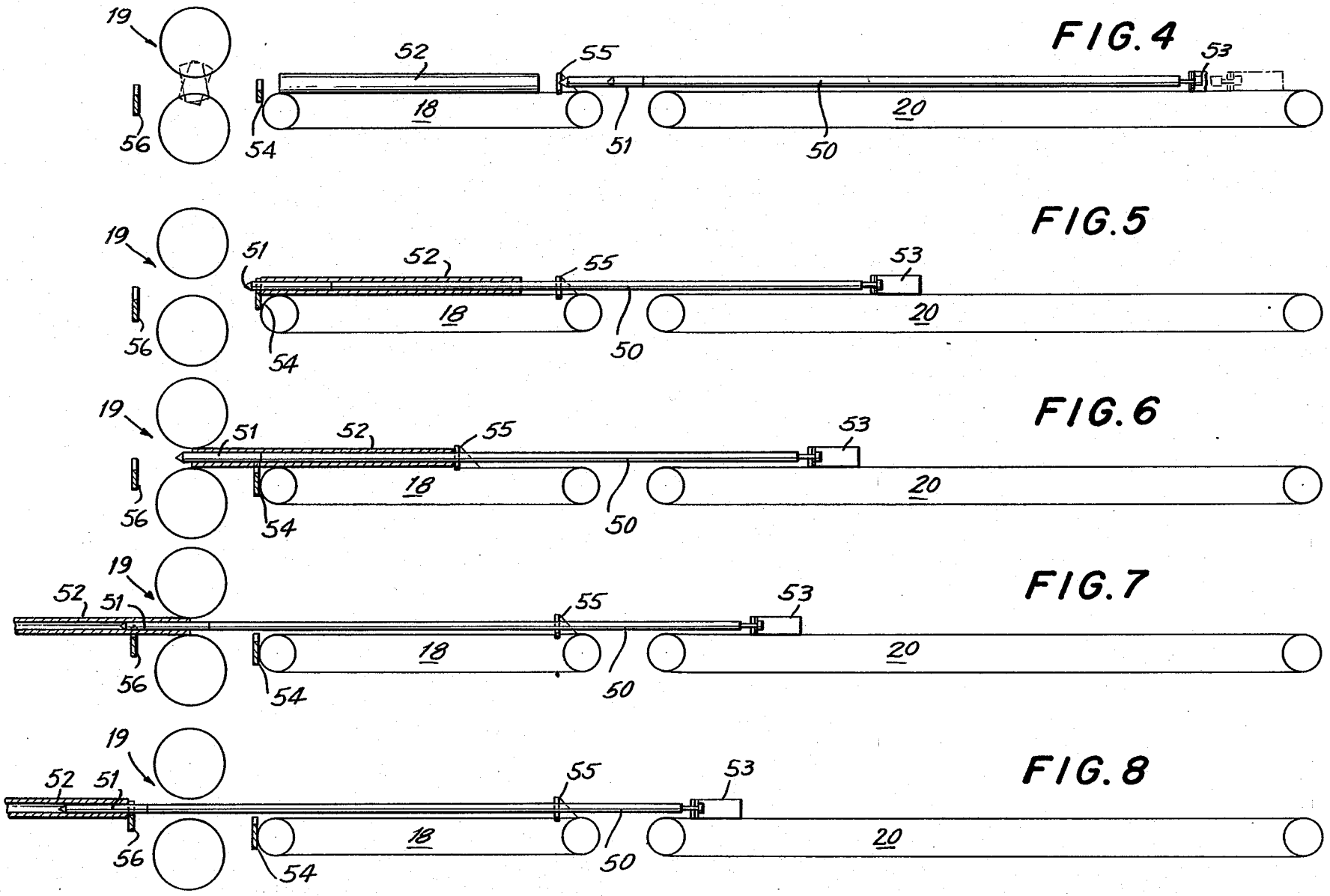
FIGS. 4–8 are sequential views illustrating the movements of shell and mandrel in the restrained mandrel Diescher mill.

As the trailing end of the shell leaves the throat of the elongator, as reflected in FIG. 7, the mandrel thrust block 53 is released for forward movement with the shell to a point slightly beyond a stripper plate 56 (see FIG. 8). The stripper plate is then elevated to engage the trailing end of the shell, after which the mandrel bar 50 is retracted by the thrust block 53 to strip the mandrel from the elongated shell and allow the shell to be further processed in the sizing mill and subsequent processing stages. The mandrel bar 50 is, at this juncture, fully retracted in preparation for the loading of the next shell. Depending upon operating conditions, the mandrel may be immediately relubricated and reused, or it may be removed for cooling and/or lubrication and replaced by a fresh mandrel.

A significant aspect of the new process is the use of a Diescher mill in a restrained bar mode, wherein the mandrel bar, instead of floating free with the shell, as the shell is passed through the Diescher mill, is physically restrained to advance at a fraction of the discharge speed of the shell from the Diescher elongator. In a typical case, for example, the advance of the mandrel would be at a rate of one sixth or less of the rate of advance of the elongated shell from the discharge side of the Diescher elongator. Additionally, the guide discs provided on the Diescher mill are operated more in the mode typical of a modern Diescher piercing mill, rather than a Diescher elongator, in that the peripheral speed of the guide discs is approximately the output speed of the elongated tube, rather than two to three times that speed as is more typical of known conventional practice.

The layout reflected in FIG. 2 is particularly advantageous for the processing of long billets, to achieve so-called "double length" pipe, up to ninety-six feet cropped length. Using two stages of Mannesmann piercers, the first for piercing purposes and the second as a No. 2 piercer (elongator), followed by a Diescher elongator. In accordance with the invention, it is possible to achieve high quality seamless tubing with overall elongations, billet to finished tubing, of eleven-to-one and greater, as output from the sizing mill. With a relatively modest capital investment, in relation to typical high production seamless tube mills, it is possible to provide for production of quality seamless tubing at rates in excess of 200,000 tons per year.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. The process of making seamless tubing, which comprises (a) furnishing a heated billet of predetermined length and diameter, (b) piercing said heated billet using cross roll piercer equipment and so conducting said piercing operation as to elongate said billet in the amount of from about 60% to about 270%, (c) elongating said pierced heated billet by means of a Diescher-type cross roll elongator having an internal mandrel, (d) during said elongating operation, restraining movement of said mandrel, relative to the discharge velocity of the tubular shell downstream of the working rolls of said elongator, to a rate of approximately one-sixth or less of said discharge velocity, (e) said Diescher-type elongator having opposed guide discs engaging the surface of said tubular shell, (f) driving said guide discs to rotate at a surface speed not substantially in excess of the discharge velocity of said tubular shell, and (g) so carrying out said elongating step that the pierced billet is further elongated from about 60% to about 160%.

* * * * *

UNITED STATES PATENT AND TRADEMARK OFFICE

CERTIFICATE OF CORRECTION

PATENT NO. : 4,578,974

DATED : April 1, 1986

INVENTOR(S) : DEZSOE A. POZSGAY, ROBERT J. RAU

It is certified that error appears in the above-identified patent and that said Letters Patent is hereby corrected as shown below:

Column 5, under the heading TYPICAL ROLLING SCHEDULE I, sub-heading PIERCER (HOT), under WALL, "0.684" should read --0.664-- and "0.1919" should read --0.686--.

Column 6, under the heading TYPICAL ROLLING SCHEDULE I, sub-heading DIESCHER MILL (HOT), under WALL RED, "0.268" should read --0.350--.

Column 6, under the heading TYPICAL ROLLING SCHEDULE I, sub-heading SIZING MILL (HOT), under WALL RED, "-2.49" should read -- -2.40--.

Signed and Sealed this

*Twenty-sixth* Day of *August 1986*

[SEAL]

*Attest:*

DONALD J. QUIGG

*Attesting Officer*

*Commissioner of Patents and Trademarks*